United States Patent [19]

Hufton

[11] 4,028,827

[45] June 14, 1977

[54] SIGN

[75] Inventor: Austen B. Hufton, Glen Ellyn, Ill.

[73] Assignee: Servicemaster Industries Inc., Downers Grove, Ill.

[22] Filed: Jan. 15, 1976

[21] Appl. No.: 649,270

[52] U.S. Cl. ..... 40/128; 116/173

[51] Int. Cl.[2] ..... G09F 7/22

[58] Field of Search ..... 40/128, 125 R, 129 R, 40/129 C, 218, 125 H; 116/173, 114 K

[56] References Cited

UNITED STATES PATENTS

| | | | |
|---|---|---|---|
| 1,371,079 | 3/1921 | Drosin et al. | 40/128 X |
| 2,794,414 | 6/1957 | Reifschneider | 116/173 |
| 3,148,856 | 9/1964 | Orlando | 116/114 K X |
| 3,241,516 | 3/1966 | Hopkins | 116/173 |
| 3,315,926 | 4/1967 | Trenda et al. | 116/173 X |
| 3,599,599 | 8/1971 | Jones | 116/173 |
| 3,708,897 | 1/1973 | Adams et al. | 40/128 X |
| 3,797,151 | 3/1974 | Dexter | 40/129 C |

*Primary Examiner*—John F. Pitrelli
*Attorney, Agent, or Firm*—Allegretti, Newitt, Witcoff & McAndrews

[57] ABSTRACT

The improved sign disclosed herein is particularly adapted for use in an institutional building, such as a hospital, for warning persons of temporary, potential hazards relating to maintenance work and the like. The improved sign includes a base member which may be quickly and easily mounted on and dismounted from the metal doorframe normally found in such institutional buildings. The base member includes a magnet for mounting the sign on the metal doorframe and the like, and a rod end holder for receiving and holding one end of a telescoping, elongated rod that projects outwardly from the base member and thus, from the metal doorframe and the like. A piece of material is mounted on the other end of the elongated rod and includes a cautionary warning message.

3 Claims, 4 Drawing Figures

SIGN

BACKGROUND OF THE INVENTION

The present invention relates to signs, and more specifically, to an improved sign particularly adapted to be used temporarily in various locations in an institutional building for the purpose of warning persons of potential hazards relating to ongoing maintenance work and the like being done in the vicinity of the sign.

In the past, a variety of different types of signs have been utilized in modern institutional buildings to warn persons of temporary, potentially hazardous situations resulting from maintenance work, construction work, etc. which was being done nearby. While these prior signs have generally satisfactorily performed their intended function, they have had several disadvantages. Most, if not all, of these prior signs were designed to be positioned or mounted on the floor. Consequently, these prior signs sometimes, themselves, constitute a hazard to passersby, and not infrequently, a person cleaning, e.g. mopping, the floor had to interrupt their cleaning operation and move the sign. In addition, these prior floor signs have tended to be relatively heavy and bulky, and this sometimes persented handling and storage problems.

It is a primary object of my present invention to provide an improved sign which is readily mounted and dismounted from the metal door frames found in most modern institutional buildings, which is particularly adapted to be used to warn passersby of temporary, potential hazards in the vicinity due to maintenance work and the like, which has a relatively lightweight and inexpensive construction and which may be quickly and easily assembled and disassembled for facile handling and storage. A further object of the present invention is to provide an improved sign which may be suspended at any selected height above the floor so that the sign, itself, does not present any safety hazards or an obstruction.

More specifically, the improved sign of my present invention includes a generally rectangular base member. Generally parallel, first and second surfaces are formed and arranged, in a back to back fashion, on the base member. The first surface is adapted to face the metal doorframe and the like when the sign is mounted on the doorframe. A magnet is secured to the first surface and is the means by which the base member is attached to the metal doorframe. A rod end holder is secured to the second surface adjacent to the lower end of the base member. This rod end holder is designed to selectively receive and hold one end of an elongated, telescoping rod so that when the one end of the elongated rod is being held by the rod end holder, the elongated rod projects from the second surface of the base member at an acute angle with respect to the second surface. The piece of material, having a cautionary warning message thereon, is mounted on the other end of the elongated rod. The piece of material has a hem along one of its ends, and the other end of the elongated rod is adapted to extend in and through the hem so as to mount the piece of material on the elongated rod.

Because of its simple design and construction, my improved sign may be manufactured at a relatively low cost as compared with the prior floor signs now in common usage. Similarly, my improved sign has a much lighter construction than the presently available floor signs.

As noted above, my improved sign may be easily and readily mounted to and dismounted from a metal doorframe commonly found in modern institutional buildings. Thus, my improved sign may be attached to a doorframe while maintenance or construction activity was being undertaken in the vicinity and then once the maintenance or construction activity has been completed, the sign may be readily removed from the doorframe without leaving any marks thereon.

Furthermore, my improved sign is designed so that the warning message will be positioned out away from the wall adjacent to the doorframe on which the sign is mounted so that it will be clearly visible to persons walking by without presenting any hazard itself and without being an obstacle that persons may trip over or have to work around.

These and other objects and advantages of my present invention will become apparent from the foregoing description of the preferred embodiment of my invention, described in connection with the accompanying drawing.

DESCRIPTION OF THE DRAWING

FIG. 1 is a perspective view of an improved sign of my present invention shown attached to a metal doorframe or the like;

Figure 1:
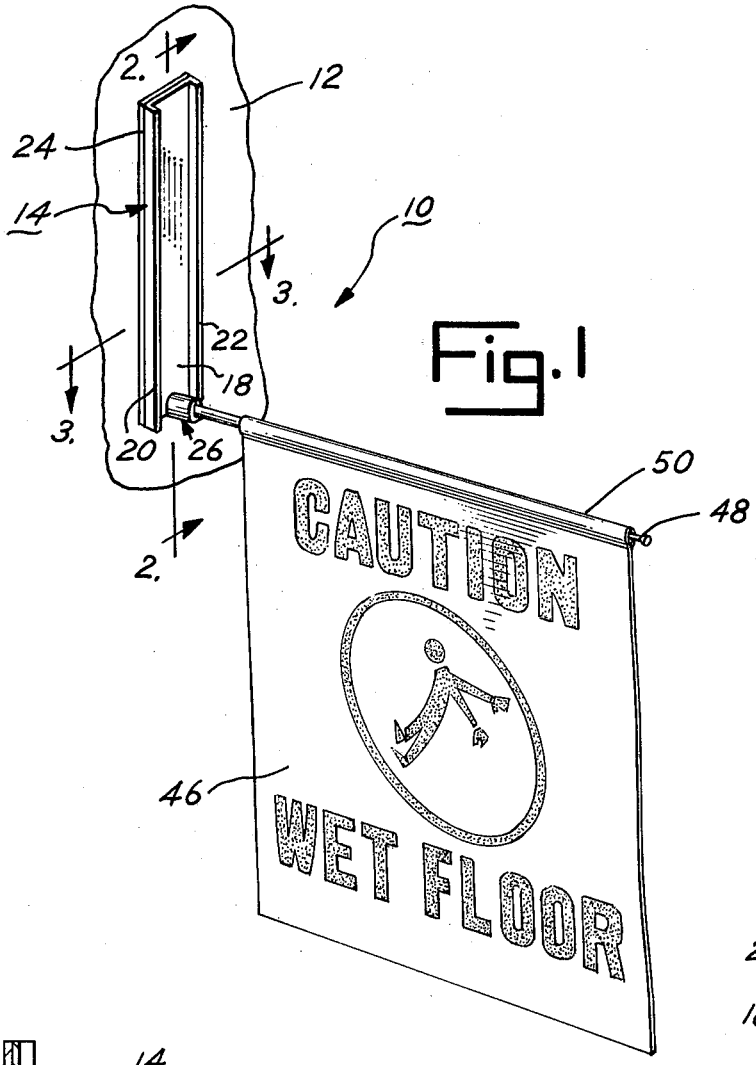

Throughout the various figures of the drawing, the same reference numerals will be used to designate the same parts or components. Moreover, when the terms "right", "left", "right end", "left end", "upper" and "lower" are used herein, it is to be understood that these terms have reference to the structure shown in the drawing as it would appear to the person viewing the drawing.

DETAILED DESCRIPTION OF THE PREFERRED EMBODIMENT

Referring now to FIG. 1, an improved sign embodying principles of my present invention is generally shown at 10 and is adapted to be readily mounted and dismounted from a metal member such as a metal doorframe 12 commonly found in an institutional building such as a hospital and the like. While the sign 10 may, of course, carry a variety of messages, the sign 10 is particularly adapted to warn passerbys of the potential safety hazards resulting from the performance of maintenance work, construction work, etc. which is being done in the vicinity of the doorframe 12 on which the sign 10 is temporarily mounted.

The sign 10 includes a generally rectangular base member 14. Generally parallel, first and second surfaces 16 and 18 are formed, back to back, on the base member 14. When the sign 10 is mounted on the doorframe 12, the first surface 16 faces the metal doorframe 12, and the second surface 18 faces away from the metal door frame 12. The lateral edges 20 and 22 of the base member are bent so as to be disposed at an angle of approximately 90° with respect to the second surface 18 and so that they extend in the same direction as the second surface 18 faces.

A conventional magnet 24, having the same general configuration as the first surface 16, is secured to the first surface 16 by, for example, an adhesive. The magnet 24 has sufficient strength so that it can secure the sign 10 to the metal doorframe 12. The use of the magnet 24 permits the sign 10 to be readily mounted or dismounted from the metal doorframe 12 without requiring the use of any fixture or the like that would mar the appearance of the doorframe.

Figure 3:
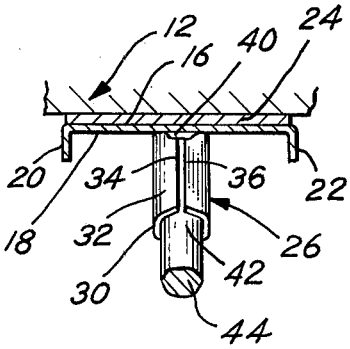
FIG. 3 is a transverse, cross-sectional view taken along the line 3—3 in FIG. 1.
Figure 4:
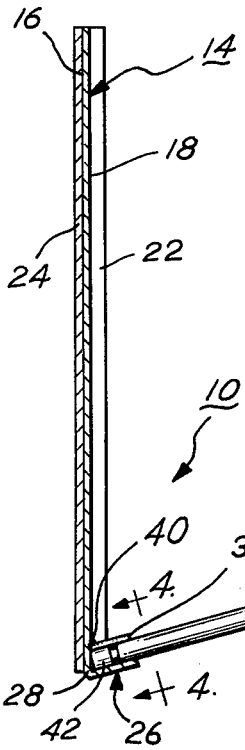
FIG. 4 is a cross-sectional, detail view taken along the line 4—4 in FIG. 2.
Figure 4:
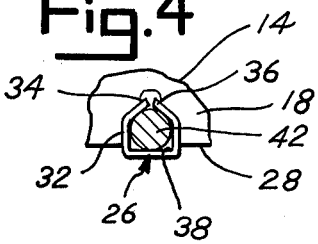
Figure 2:
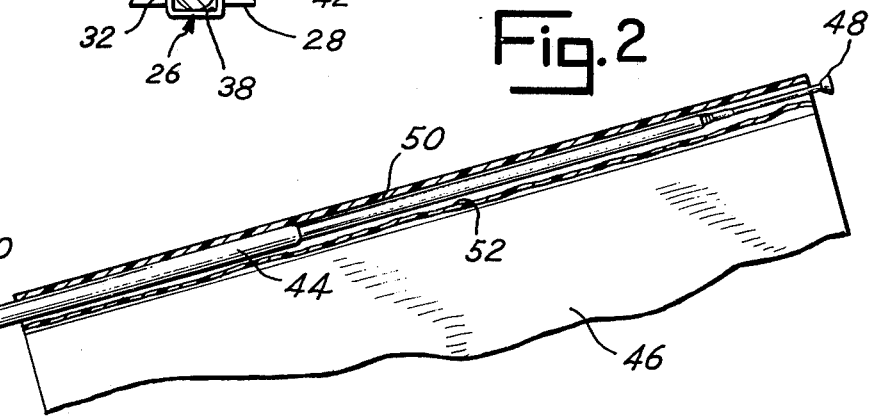
FIG. 2 is a vertical, cross-sectional view taken along the line 2—2 in FIG. 1.

A rod end holder 26 is secured to the second surface 18 of the base member 14 adjacent to the lower end 28 of the base member 14. The open, distal end 30 of the rod end holder 26 projects from the second surface 18 and is disposed beyond the lateral edges 20 and 22. As best illustrated in FIGS. 2–4, the rod end holder 26 is formed from a single piece or sheet of material 32 which may be an integral, extended part of the base member 14 and which is then folded or bent so that its lateral edges 34 and 36 are disposed adjacent to each other and so that a generally cylindrical recess 38 is defined by the piece of material 32. By means of welding or soldering, such as shown at 40, the rod end holder 26 is retained in its desired, preselected relationship with respect to the second surface 18 of the base member 14. Preferably, the rod end holder 26 is positioned, with respect to the plane of the second surface 18, so that the longitudinal axis of the recess 38 forms an angle of approximately 75° with the plane of the second surface 18 and is disposed in a plane that includes the longitudinal central axis of the base member 14.

One end 42 of a conventional, telescoping elongated rod 44 tightly fits within the recess 38 of the rod end holder 26. The telescoping construction of the elongated rod 44 permits the length of the elongated rod to be selectively varied. The "fit" between the end 42 and the recess 38 is sufficiently close or tight so that the elongated rod 44 cannot be easily dislodged from the rod end holder 26. When the elongated rod 44 is disposed within the recess 38, the longitudinal axis of the elongated rod 44 is coaxial with the longitudinal axis of the recess 38, i.e. the longitudinal axis of the elongated rod 44 also forms an angle of approximately 75° with respect to the plane of the second surface 18.

A piece of relatively flexible material 46, such as plastic or cloth, is mounted on the enlarged, other end 48 of the elongated rod 44. The piece of material 46 may include a message thereon, and as shown best in FIG. 4, may include a warning or cautionary message regarding a potentially hazardous condition. As best shown in FIG. 2, the piece of material 46 has a hem 50 formed in one end thereof, and the "loop" 52, defined by the hem 50, is of sufficient size that the other end 48 of the elongated rod 44 can extend into and through the loop 52. When the other end 48 of the elongated rod 44 is disposed in or through the loop 52 of the hem 50, the piece of material 46 is securely mounted on the rod 44.

As noted above, the elongated rod 44 has a telescoping construction and thus, the length of the rod 44 may be varied. Use of the telescoping elongated rod 44 permits the piece of material 46 to be positioned at varying distances from the metal doorframe 12. Alternatively, of course, the elongated rod 44 can have a non-telescoping construction.

In one embodiment of the sign 10 that has been constructed and tested, the base member 14 is made from a metal sheet and the rod end holder 26 is formed as an integral extension of the base member 14. The elongated rod 44 is a metal antenna of the type normally used with radios and the like. Alternatively, if a non-telescoping elongated rod 44 is desired, the elongated rod can be made from fiberglass or any other similar plastic material. The piece of material 46 is a flexible plastic material, although, of course, the piece of material 46 could also be cloth.

As noted above, one of the primary advantages of the sign 10 is that it has a simple, yet sturdy construction. This allows the sign 10 to be manufactured relatively inexpensively but still have a long life expectancy. In addition, the construction and design of the sign 10 permits it to be relatively lightweight and in fact, its overall weight is approximately one-sixth of that of the conventional floor signs now in use.

Furthermore, the sign 10 can be relatively quickly disassembled, and when disassembled, requires only a minimal storage space. In this regard, the sign 10 may be disassembled by slipping the piece of material 46 off of the other end 48 of the elongated rod 44. Thereafter, the elongated rod 44 is pulled axially with respect to the rod end hold 26 so that its end 42 is removed from the recess 38. The elongated rod 44 is then telescoped so that it has a minimal length, and the elongated rod 44 is disposed adjacent to the base member 14 so that the longitudinal axis of the rod 44 is substantially parallel to the plane of the surfaces 16 and 18. Thereafter, the piece of material 46 may be wrapped around the rod 44 and the base member 14 for compact storage. When it is desired to assemble the sign 10, the piece of material 46 is unwrapped. The end 42 of the elongated rod 44 is again introduced into the recess 38. The other end 48 of the elongated rod 44 is then inserted into the loop 52 defined by the hem 50 so that the hem 50 slips over the other end 48 until the material 46 is positioned, with respect to the elongated rod 44, as shown in FIGS. 1 and 2.

As will be recognized by those having skill in this art, the construction of the sign 10 may be modified from that specifically described hereinabove. For example, the configuration and shape of the magnet 24 may be changed and the magnetic 24 could be secured to the base member 14 by means other than an adhesive. The telescoping construction of the rod 44 may be replaced by a rod having a fixed length. Thus, since the invention disclosed herein may be embodied in other specific forms without departing from the spirit or characteristics thereof, the embodiment of my invention described herein is therefore to be considered in all respects as illustrative and not restrictive, the scope of my invention being indicated by the appended claims, rather than by the foregoing description and all changes which come within the meaning and range of equivalency of the claims are therefore intended to be embraced therein.

I claim:

1. An improved warning sign which may be quickly and easily mounted on and dismounted from a metal doorframe or the like in an institutional building, such as a hospital, for the purpose of alerting persons to temporary, potential hazards relating to maintenance work and the like begin done in the vicinity, the improved warning sign comprising:

a base member having first and second, parallel, generally rectangular surfaces which are substantially flat and which are disposed back to back to each other and having integral, longitudinal, lateral edges which are disposed substantially perpendicular to the planes of the first and second surfaces and which project from the plane of the second surface, the first surface being adapted to face the metal doorframe and the second surface being adapted to face away from the metal doorframe when the sign is mounted on the metal doorframe;

means for mounting the base member on the metal doorframe, the mounting means including a magnet which is secured to the first surface of the base member and which has a size and shape so that the magnet overlies substantially all of the first surface and so that when the first surface faces the metal doorframe, the magnet is adjacent to and in contact with the metal doorframe;

an elongated, telescopable rod which has a first end and a second end and which is constructed so that its second end may be selectively moved longitudinally with respect to its first end so as to permit the length of the elongated, telescopable rod to be varied;

a rod end holder integrally formed as a part of the base member, adjacent to one end of the base member, for selectivity receiving and holding the first end of the elongated, telescopable rod so that when the first end of the elongated, telescopable rod is being held by the rod end holder, the elongated, telescopable rod extends and projects from the second surface of the base member at a preselected, acute angle with respect to the second surface of the base member;

a piece of material having a cautionary warning message thereon; and means for selectivity mounting the piece of material on the elongated, telescopable rod at a point between the first and second ends of the elongated, telescopable rod.

2. The improved sign described in claim 1 wherein the elongated rod, when its first end is held by the rod end holding means, forms an angle of approximately 75° with the second surface of the base member.

3. The improved sign described in claim 1 wherein the piece of material is flexible; and wherein means for mounting the piece of material on the elongated rod includes a hem which is formed along one edge of the piece of material and which defines a loop that is of sufficient size that the second end of the elongated rod can fit within and extend through the loop of the hem.

* * * * *